US006214132B1

(12) United States Patent
Nakayama et al.

(10) Patent No.: US 6,214,132 B1
(45) Date of Patent: Apr. 10, 2001

(54) CONDITIONING METAL SURFACES PRIOR TO PHOSPHATE CONVERSION COATING

(75) Inventors: Takaomi Nakayama; Yasuhiko Nagashima; Kensuke Shimoda, all of Hiratsuka (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/380,700

(22) PCT Filed: Mar. 9, 1999

(86) PCT No.: PCT/US98/03934

§ 371 Date: Sep. 3, 1998

§ 102(e) Date: Sep. 3, 1999

(87) PCT Pub. No.: WO98/39498

PCT Pub. Date: Sep. 11, 1998

(30) Foreign Application Priority Data

Mar. 7, 1997 (JP) ..... 9-052181

(51) Int. Cl.[7] ..... C23C 22/78

(52) U.S. Cl. ..... 148/254; 148/259; 106/14.12; 106/14.44

(58) Field of Search ..... 148/254, 259; 106/14.12, 14.44

(56) References Cited

U.S. PATENT DOCUMENTS

| | | | | |
|---|---|---|---|---|
| 2,310,239 | | 2/1943 | Jernstedt | 148/254 |
| 2,322,349 | | 6/1943 | Jernstedt | 148/254 |
| 2,456,947 | * | 12/1948 | Jernstedt | 148/254 |
| 2,874,081 | | 2/1959 | Cavanagh et al. | 148/254 |
| 3,728,163 | * | 4/1973 | Morrison et al. | 148/254 |
| 3,847,663 | * | 11/1974 | Shumaker | 148/254 |
| 4,063,968 | | 12/1977 | Matsushima et al. | 148/259 |
| 4,311,536 | | 1/1982 | Schapira et al. | 148/254 |
| 4,497,667 | * | 2/1985 | Vashi | 148/254 |
| 4,517,030 | * | 5/1985 | Yamamoto et al. | 148/254 |
| 4,844,748 | * | 7/1989 | Charbonnier et al. | 148/254 |
| 5,061,314 | * | 10/1991 | Collier et al. | 106/14.44 |

FOREIGN PATENT DOCUMENTS

| | | |
|---|---|---|
| 1546070 | 6/1969 | (DE) . |
| 9508007 | 3/1995 | (EP) . |
| 1531888 | 11/1968 | (FR) . |
| 2172073 | 9/1973 | (FR) . |
| 2286889 | 4/1976 | (FR) . |
| 2375340 | 7/1978 | (FR) . |
| 2461020 | 1/1981 | (FR) . |

OTHER PUBLICATIONS

Japan 63–76883 (Apr. 7, 1988)—Derwent Abstract only—Accession No: 1988–266443 [38]; Sec. Acc. no CPI: C1988–118487; Derwent Class: M14.

Japan 56–156778 (Dec. 3, 1981)—Derwent Abstract only—Accession No: 1982–04576E [03]; Derwent Class: M14 M24.

Japan 57–23066 (Feb. 6, 1982)—Derwent Abstract only—Accession No: 1982–20885E [11]; Derwent Class M 14.

Chemical Abstracts, vol. 84, no. 22, May 31 1976; abstract no. 154092c, Mizno H.: "phosphate treatment of steel sheet and galvanized steel", p. 239; XP002135087 & JP 50 153736 (Nippon Kokan).

Chemical Abstracts, vol. 96, no. 24, Jun. 14 1982; abstract no. 203812w, Sorkin, G.N.: "Possibility of activating a metal surface in a suspension sludge from zinc phosphate baths", p. 265; XP002135800 & Izv. Sib. Otd. Akad. Nauk SSSR, vol. 6, no. 6, 1981 pp. 147–150.

* cited by examiner

*Primary Examiner*—Deborah Jones
*Assistant Examiner*—Robert R. Koehler
(74) *Attorney, Agent, or Firm*—Wayne C. Jaeschke; Stephen D. Harper; Norvell E. Wisdom, Jr.

(57) ABSTRACT

A pretreatment before phosphating conversion coating is effected by contacting a metal substrate to be coated with a pretreatment composition that has a pH from 4 to 13 and contains dispersed fine particle size alkali metal or ammonium salts and divalent or trivalent metal phosphates. The conditioning achieved is as good as with conventional Jernstedt salts and the pretreatment compositions according to the invention are more storage stable.

20 Claims, No Drawings

CONDITIONING METAL SURFACES PRIOR TO PHOSPHATE CONVERSION COATING

This application is the national phase under 35 U.S.C. §371 of PCT International Application No. PCT/US98/03934 which has an International filing date of Mar. 9, 1998 which designated the United States of America.

FIELD OF THE INVENTION

This invention relates to a surface conditioning pretreatment bath and surface conditioning process for use prior to the phosphate conversion coating treatments that are executed on the surfaces of metals such as iron and steel, zinc-plated steel sheet, aluminum, and the like. The subject surface conditioning pretreatment bath and process have the effect of accelerating the conversion reactions and shortening the reaction time in the ensuing conversion treatment, while also producing finer crystals in the phosphate coating.

DESCRIPTION OF RELATED ART

The formation of fine-sized, dense phosphate coating crystals on metal surfaces is currently required in the field of automotive phosphate treatments in order to improve the post-painting corrosion resistance and in the field of phosphate treatments for cold-working applications in order to reduce the friction during working such as drawing and extend the life of the working tools. This requirement has led to the execution of a surface conditioning step prior to the phosphate conversion coating treatment. The purpose of the surface conditioning step is to activate the metal surface and produce nuclei for deposition of the phosphate coating crystals in order to ultimately produce fine-sized, dense crystals in the phosphate coating. A typical phosphate conversion coating process that produces fine-sized, dense phosphate coating crystals can be exemplified as having the following steps:

(1) Degreasing and/or other cleaning
(2) Tap water rinse (often multistep)
(3) Surface conditioning
(4) Phosphate conversion coating treatment
(5) Tap water rinse (often multistep)
(6) Rinse with pure water.

The surface conditioning step is carried out in order to render the phosphate coating crystals fine-size and dense. Compositions for this purpose are known, for example, from U.S. Pat. Nos. 2,874,081, 2,322,349, and 2,310,239. Disclosed therein as the main constituents of the surface conditioner are titanium, pyrophosphate ions, orthophosphate ions, sodium ions, and the like. These surface conditioning compositions, known as Jernstedt salts, provide titanium ions and colloidal titanium in their aqueous solutions. The colloidal titanium becomes adsorbed to the metal surface when the degreased and water-rinsed metal is dipped in an aqueous solution of such a surface conditioning composition or when the metal is sprayed with the surface conditioning pretreatment bath. The adsorbed colloidal titanium functions in the ensuing phosphate conversion coating treatment step as nuclei for deposition of the phosphate coating crystals, thereby accelerating the conversion reactions and causing the phosphate coating crystals to be finer-sized and denser. The surface conditioning compositions in current industrial use all employ Jernstedt salts. However, the use in the surface conditioning step of colloidal titanium generated from Jernstedt salts is associated with a variety of problems.

The first problem is a deterioration with time in the surface conditioning pretreatment bath. While the heretofore employed surface conditioning compositions do provide remarkable fine-sizing and densifying effects on the phosphate coating crystals immediately after preparation of the aqueous solution of the composition, this activity can be lost several days after preparation because of aggregation of the colloidal titanium. This loss in activity, which manifests as a coarsening of the phosphate coating crystals, occurs regardless of whether the surface conditioning pretreatment bath has actually been used during this several day period. To respond to this problem, Japanese Patent Application Laid Open (Kokai or Unexamined) Number Sho 63-76883 (76,883/1988) teaches a process for managing and maintaining the surface conditioning activity by measuring the average particle size of the colloidal titanium in the surface conditioning pretreatment bath and continuously discarding bath so as to keep the average particle size below a prescribed value. Fresh surface conditioning composition is also supplied to make up for the discarded portion. This method does permit a quantitative management of the factors related to the activity of the surface conditioning pretreatment bath, but at the same time this method requires that large amounts of the surface conditioning pretreatment bath be discarded in order to maintain an activity level equal to that of the initially prepared aqueous solution. This creates an additional problem with respect to the waste water treatment capacity of the plant where the process is carried out. In sum, the activity is maintained by the combination of continuously discarding the surface conditioning pretreatment bath and make up of the entire quantity.

The second problem is that the activity and life of the surface conditioning pretreatment bath are substantially affected by the quality of the water used for bath buildup. Industrial-grade water is generally used to make up the surface conditioning pretreatment bath. However, as is well known, industrial-grade water contains cationic components which are a source of total hardness, e.g., magnesium and calcium, and the content of these components varies as a function of the source of the industrial-grade water used for bath buildup. It is also known that the colloidal titanium, which is the principal component of the heretofore used surface conditioning pretreatment baths, bears an anionic charge in aqueous solution and that the resulting mutual electrical repulsion prevents its sedimentation and supports the maintenance of its disperse state.

As a consequence, the presence of large amounts of cationic calcium or magnesium in the industrial-grade water causes electrical neutralization of the colloidal titanium. This in turn causes a loss of the repulsive force between the particles of dispersed titanium colloid, which results in aggregation and sedimentation and hence in a loss of activity. The addition of a condensed phosphate such as pyrophosphate to the surface conditioning pretreatment bath has been proposed for the purpose of blocking the cationic component and maintaining the stability of the colloidal titanium. However, when condensed phosphate is added in large amounts to a surface conditioning pretreatment bath, the condensed phosphate reacts with the surface of steel sheet with the formation thereon of an inert coating and in this manner causes conversion coating defects in the ensuing phosphate conversion coating treatment step. At locations where the calcium and magnesium content is very high, pure water must be used for buildup of the surface conditioning pretreatment bath and for feed to the bath; this is a major economic drawback.

Restrictions on temperature and pH during use of prior art colloidal titanium conditioning treatments are a third problem. In specific terms, at a temperature above 35° C. or a pH outside the range from 8.0 to 9.5, colloidal titanium usually undergoes aggregation and cannot exhibit its surface conditioning activity. The prior art surface conditioning compositions must therefore be used at a prescribed temperature and pH range. It is also not possible to generate a long-term cleaning and activating activity for metal surfaces using a single liquid comprising the combination of surface conditioning composition with degreaser, etc.

A fourth problem concerns the limitation on the degree of fine-sizing of the phosphate coating crystals that can be achieved through the activity of the surface conditioning pretreatment bath. The surface conditioning activity is generated by the adsorption of colloidal titanium on the metal surface, which creates nuclei for the deposition of the phosphate coating crystals. As a result, the phosphate coating crystals become denser and finer as the number of colloidal titanium particles adsorbed on the metal surface during the surface conditioning step increases. This would upon initial analysis lead to the idea of increasing the number of colloidal titanium particles in the surface conditioning pretreatment bath, i.e., increasing the colloidal titanium concentration. However, an increase in the concentration also leads to an increase in the frequency of collision among colloidal titanium particles in the surface conditioning pretreatment bath, which causes aggregation and sedimentation of the colloidal titanium. As a result, the current normally used upper limit on the colloidal titanium concentration is 100 parts by weight of colloidal titanium (measured as its stoichiometric equivalent as elemental titanium) per million parts of the total composition, a concentration unit that may be used hereinafter for any ingredient in any mixture and is usually abbreviated as "ppm", in the surface conditioning pretreatment bath, and the prior art has been unable to provide finer-sized phosphate coating crystals by increasing the colloidal titanium concentration above this limit.

It is within this context that Japanese Patent Application Laid Open (Kokai or Un-examined) Numbers Sho 56-156778 (156,778/1981) and Sho 57-23066 (23,066/1982) have proposed a surface conditioning process which employs the insoluble phosphate of a divalent or trivalent metal as the surface conditioner rather than a Jernstedt salt. In this technology, a suspension containing the insoluble phosphate of a divalent or trivalent metal is blown under elevated pressure onto the surface of a steel band or ribbon. However, this surface conditioning technology is effective only when the suspension is blown onto the workpiece under elevated pressure and thus cannot be used for surface conditioning in phosphate conversion coating treatments in which surface conditioning is generally carried out by dipping or spraying.

In addition, Japanese Patent Publication (Kokoku) Number Sho 40-1095 (1,095/1965) teaches a surface conditioning process in which galvanized steel sheet is dipped in a highly concentrated suspension of an insoluble phosphate of a divalent or trivalent metal. The working examples provided for this process are limited to galvanized steel sheet, and in addition this process uses a highly concentrated insoluble phosphate suspension with a minimum concentration of 30 grams of insoluble phosphate particles per liter of total suspension, a concentration unit that may be used hereinafter for other materials in addition to colloidal phosphates that are dissolved or dispersed in any liquid phase and is generally abbreviated "g/L".

In summary, then, although Jernstedt salts suffer from a variety of drawbacks, a more effective technology that can replace Jernstedt salts has yet to appear.

PROBLEMS TO BE SOLVED BY THE INVENTION

An object of the present invention is to solve the problems described above for the prior art by providing a novel surface conditioning pretreatment bath that evidences an excellent stability over time, that can accelerate the conversion reactions and shorten the conversion reaction time in an ensuing phosphate conversion coating treatment, and/or that can provide finer-sized crystals in the ultimately obtained phosphate coating. An additional object of the invention is to provide a surface conditioning process with these same features.

SUMMARY OF THE INVENTION

The above noted problems with prior art methods of conditioning metal surfaces for phosphate coating can be overcome, and additional improvements in the quality of the phosphate coating crystals by using a pretreatment bath that characteristically has a pH adjusted to 4 to 13 and contains alkali metal salt or ammonium salt or a mixture thereof and at least one selection from phosphates that contain at least one type of divalent or trivalent metal cations and that include particles with a particle size ≦5 micrometres (hereinafter usually abbreviated as "μm").

DETAILED DESCRIPTION OF THE INVENTION AND PREFERRED EMBODIMENTS

The concentration of the ≦5-μm particles is preferably from 0.001 to 30 g/L, and the aforesaid divalent or trivalent metal is preferably at least one selection from Zn, Fe, Mn, Ni, Co, Ca, and Al. The aforesaid alkali metal salt or ammonium salt independently is preferably at least one salt selected from the orthophosphates, metaphosphates, orthosilicates, metasilicates, carbonates, bicarbonates, and borates and independently is preferably present in a concentration of 0.5 to 20 g/L. In addition, the bath preferably additionally contains at least one selection from the group consisting of water-soluble anionic organic polymers, water-soluble nonionic organic polymers, anionic surfactants, nonionic surfactants, and microparticulate oxides that disperse in an anionically charged state. This microparticulate oxide that disperses in an anionically charged state preferably has an average particle size ≦0.5 μm and is preferably present in a concentration from 0.001 to 5 g/L. The subject microparticulate oxide that disperses in an anionically charged state is desirably at least one selection from the oxides of Si, B, Ti, Zr, Al, Sb, Mg, Se, Zn, Sn, Fe, Mo, and V.

A metal surface conditioning process according to the present invention that precedes phosphate conversion coating treatment is characterized by contacting the metal surface with the surface conditioning pretreatment bath described above.

Because a surface conditioning pretreatment bath according to the present invention has a much better stability at high pH's and high temperatures than the prior art products, it can be combined with builder and nonionic or anionic surfactant(s) or mixtures thereof and used to effect a process that can simultaneously clean and activate the metal surface.

What are believed to be the functions of the various components in the present invention will be explained in detail below, but the invention is not to be understood as limited by any such belief or theory.

Phosphates containing at least one divalent or trivalent metal (abbreviated below simply as "divalent or trivalent metal phosphates") are an essential component in the present invention. These dispersed divalent or trivalent metal phosphate particles with a suitable particle size, through adsorption on the surface of the workpiece from an aqueous solution containing other specific ingredients, form nuclei for ensuing phosphate coating crystal deposition and also increase the rate of the phosphate conversion reactions.

From the standpoint of corrosion resistance quality of the subsequently conversion coated substrate, the particle size of the divalent and trivalent metal phosphate particles dispersed in a pretreatment composition according to the invention preferably is not more than, with increasing preference in the order given, 4.5, 3.5, 2.5, 1.5, 0.50, 0.40, 0.25, or 0.10 $\mu$m. As may be seen from the working examples below, the corrosion resistance after zinc phosphating and painting is better, the smaller the particle size of dispersed phosphate used in a composition according to the invention, and the phosphate coating weight is smaller when smaller particle size phosphate dispersates are used. However, the improvement in quality and decrease in coating weight achieved by using dispersed phosphate particles substantially smaller than 5 $\mu$m are fairly small, and may not economically justify the use of extremely small size phosphate dispersates in a pretreatment composition according to this invention, because the cost of the finer dispersates is higher than that of the coarser ones.

The dispersed phosphate particles preferably contains at least some of the same chemical type(s) of divalent or trivalent metal cation(s) as does the phosphate coating to be formed after the pretreatment according to the invention is used. Thus, if a predominantly zinc cations-containing phosphate is to be formed, zinc cations preferably predominate also among the cations in the phosphates dispersed in a pretreatment composition according to this invention. On the other hand, if a manganese phosphate conversion coating is to be used, predominantly manganese phosphates are preferably used as the dispersates in a pretreatment composition according to the invention. Inasmuch as this divalent or trivalent metal phosphate component resembles one component in phosphate conversion treatment baths and phosphate conversion coatings, another advantage of the subject divalent or trivalent metal phosphate is that it will not negatively affect the conversion treatment bath when carried over into that bath and will not adversely affect the performance of the phosphate conversion coating when taken into the conversion coating as nuclei. The divalent or trivalent metal phosphate used in the present invention is exemplified by the following: $Zn_3(PO_4)_2$, $Zn_2Fe(PO_4)_2$, $Zn_2Ni(PO_4)_2$, $Ni_3(PO_4)_2$, $Zn_2Mn(PO_4)_2$, $Mn_3(PO_4)_2$, $Mn_2Fe(PO_4)_2$, $Ca_3(PO_4)_2$, $Zn_2Ca(PO_4)_2$, $FePO_4$, $AlPO_4$, $CoPO_4$, and $Co_3(PO_4)_2$.

The presence of divalent or trivalent metal phosphate particles with sizes in excess of 5 $\mu$m in the surface conditioning pretreatment bath according to the present invention does not harm the advantageous effects of the present invention, provided that the concentration of the $\leqq$5-$\mu$m microparticles in the surface conditioning aqueous composition is suitable. However, the average size of the ultimately produced phosphate coating crystals can be controlled in the present invention by adjusting the average particle size of the divalent or trivalent metal phosphate particles that are less than 5 $\mu$m in size. The use of very finely divided divalent or trivalent metal phosphate will cause the deposition of very finely-sized phosphate crystals.

The divalent or trivalent metal phosphate concentration preferably falls in the range from 0.001 to 30 g/L. When the divalent or trivalent metal phosphate concentration is below 0.001 g/L, usually so little divalent or trivalent metal phosphate becomes adsorbed on the metal surface that accelerating the phosphate conversion reactions hardly occurs. On the other hand, little or no additional acceleration of the phosphate conversion reactions is obtained at divalent or trivalent metal phosphate concentrations in excess of 30 g/L; this makes such concentrations uneconomical. In order to achieve an optimum balance among conversion coating quality, consistency of process control, and economy, the concentration of dispersed divalent or trivalent phosphate particles in a conditioning pretreatment according to the invention more preferably is at least, with increasing preference in the order given, 0.010, 0.10, 0.50, 0.75, 1.0, 1.2, 1.6, or 1.8 g/L and independently preferably is not more than, with increasing preference in the order given, 25, 20, 15, 10, 7.5, 5.0, 4.0, 3.5, 3.0, or 2.5 g/L.

Another essential component in the present invention is the alkali metal salt or ammonium salt or mixture thereof (abbreviated below simply as the "alkali metal salt or ammonium salt"). As explained above with reference to the prior art, surface conditioning by blowing insoluble divalent or trivalent metal phosphate under elevated pressure has already been pursued in a previously disclosed process. However, this previously disclosed process requires a vigorous and persistent spray of insoluble divalent or trivalent metal phosphate under elevated pressure. The reason for the use of the elevated pressure spray is that, in order for surface conditioning activity to be produced, this process requires reaction by striking the metal surface with the insoluble phosphate or requires abrasion of the metal surface as in shot peening. In order, on the other hand, to obtain surface conditioning activity by dipping, the prior-art process requires extremely high concentrations of the insoluble divalent or trivalent metal phosphate.

The present inventors have discovered that, in the presence of dissolved alkali metal salt or ammonium salt, surface conditioning activity can be generated even by dipping in low concentrations of the insoluble divalent or trivalent metal phosphate and without the application of physical force to the metal surface. As a consequence, the present invention requires nothing more than simple contact between the workpiece and the surface conditioning pretreatment bath and thus has a reaction mechanism completely different from that in the prior art. It is for this reason that the alkali metal salt or ammonium salt is an essential component.

The particular alkali metal salt or ammonium salt is not crucial as long as it is selected from the group consisting of orthophosphates, metaphosphates, orthosilicates, metasilicates, carbonates, bicarbonates, and borates. Combinations of two or more of these alkali metal salts or ammonium salts may also be used unproblematically.

The desirable concentration range for the alkali metal salt or ammonium salt is from 0.5 to 20 g/L. Concentrations below 0.5 g/L often fail to provide surface conditioning activity by simple contact between the workpiece and surface conditioning pretreatment bath. Concentrations in excess of 20 g/L do not provide additional benefits and are therefore uneconomical. In order to achieve an optimum balance among conversion coating quality, consistency of process control, and economy, the concentration of dissolved alkali metal or ammonium salt in a conditioning pretreatment according to the invention more preferably is at least, with increasing preference in the order given, 0.010, 0.10, 0.50, 1.0,2.0,3.0,4.0, or 4.9 g/L and independently preferably is not more than, with increasing preference in the order given, 25, 20, 15, 10, 7.5, or 5.5 g/L.

The surface conditioning pretreatment bath according to the present invention must be adjusted into the pH range from 4.0 to 13.0. At a pH below 4.0, the metal usually corrodes in the surface conditioning pretreatment bath with the production of an oxide coating, which raises the possibility of defective phosphate conversion treatment. At a pH in excess of 13.0, neutralization of the acidic phosphate conversion bath by surface conditioning pretreatment bath carried over into the phosphate conversion treatment step can throw the phosphate conversion bath out of balance. In order to achieve an optimum balance among conversion coating quality, consistency of process control, and economy, the pH value in a conditioning pretreatment according to the invention more preferably is at least, with increasing preference in the order given, 4.5, 5.0, 5.5, 6.0, 6.5, 7.0, or 7.5 and independently preferably is not more than, with increasing preference in the order given, 12.0, 11.0, 10.5, 10.0, 9.5, 9.0, or 8.5.

The presence of microparticulate oxide that disperses in an anionically charged state is preferred for a composition according to this invention. The microparticulate oxide adsorbs to the metal surface with the formation of nuclei that can function as microcathodes for phosphate crystal deposition, and thus forms a starting point for the phosphate conversion reactions.

Second, the microparticulate oxide functions to improve the dispersion stability of the divalent or trivalent metal phosphate in the surface conditioning pretreatment bath. The microparticulate oxide, either by adsorbing to the divalent or trivalent metal phosphate dispersed in the surface conditioning pretreatment bath or by preventing collisions among the divalent or trivalent metal phosphate particles, improves the stability by preventing the aggregation and precipitation of the divalent or trivalent metal phosphate. As a consequence, the particle size of the microparticulate oxide must be smaller than the particle size of the divalent or trivalent metal phosphate.

The microparticulate oxide preferably has a particle size $\leqq 0.5\ \mu m$. The metal in the microparticulate oxide used by the present invention is not crucial as long as the microparticulate oxide satisfies the particle size and anionicity conditions. An initially cationic microparticulate oxide can be used after its surface charge has been converted to anionic by a surface treatment. The following are examples of microparticulate oxides that can be used by the present invention: $SiO_2$, $B_2O_3$, $TiO_2$, $ZrO_2$, $Al_2O_3$, $Sb_2O_5$, MgO, $SeO_2$, ZnO, $SnO_2$, $Fe_2O_3$, $MoO_3$, $M_2O_5$, and $V_2O_5$.

The same increase in the dispersion stability of the divalent or trivalent metal phosphate in the surface conditioning pretreatment bath according to the present invention can be obtained using anionic water-soluble organic polymer, nonionic water-soluble organic polymer, anionic surfactant, or nonionic surfactant.

The concentration of the microparticulate oxide is preferably from 0.001 to 5 ppm. A microparticulate oxide concentration below 0.001 ppm cannot usually provide the increase in dispersion stability by the divalent or trivalent metal phosphate in the surface conditioning pretreatment bath that is the main purpose for using the microparticulate oxide in the present invention. An economically motivated upper concentration limit can be established at 5 g/L because concentrations in excess of 5 g/L provide no additional increase in the dispersion stability of the divalent or trivalent metal phosphate. In order to achieve an optimum balance among conversion coating quality, consistency of process control, and economy, the concentration of microparticulate oxide particles in a conditioning pretreatment according to the invention more preferably is at least, with increasing preference in the order given, 0.003, 0.005, 0.007, or 0.009 ppm and independently preferably is not more than, with increasing preference in the order given, 4.0, 3.0, 2.0, 1.5, 1.0, 0.50, 0.25, 0.12, 0.080, 0.060, 0.040, or 0.020 ppm.

Unlike the prior art technology, the surface conditioning pretreatment bath according to the present invention retains its activity regardless of its use conditions. In more specific terms, the surface conditioning pretreatment bath according to the present invention offers the following advantages over the prior art technology: (1) It has a long storage stability; (2) its activity is not impaired by the admixture of hardness components such as Ca, Mg, and the like; (3) it can be used at high temperatures; (4) it tolerates the addition of various alkali metal salts; (5) it is very stable over a broad pH range; and (6) it provides for adjustment of the size of the ultimately obtained phosphate crystals.

Accordingly, the bath according to the present invention can also be used as a simultaneous cleaner/degreaser and surface conditioner, whereas the prior technology in this area has been unable to continuously maintain stable quality. The known inorganic alkali builders, organic builders, surfactants, and the like may be added in this application in order to improve the cleaning capacity in the degreasing and surface conditioning step. Regardless of whether or not degreasing and surface conditioning are being run simultaneously, the known chelating agents, condensed phosphates, and the like that are used for degreasing/cleaning may be added to a conditioning composition according to this invention in order to negate the effects of cationic components that may be carried into the surface conditioning pretreatment bath.

A surface conditioning process according to the present invention involves simply contacting the metal surface with the surface conditioning pretreatment bath. The contact time and bath temperature are not critical. The surface conditioning process according to the present invention can be applied to any metal on which a phosphate treatment can be executed, e.g., iron, steel, galvanized steel sheet, aluminum, and aluminum alloys.

The advantageous effects from application of the surface conditioning pretreatment bath according to the present invention will be illustrated in greater detail through the working and comparative examples that follow. While an automotive-grade zinc phosphate treatment is provided as an example of the phosphate treatment, the use of a surface conditioning pretreatment bath according to the present invention is not limited to this type of phosphate conversion treatment.

Sample panels

The abbreviations and specifications for the sample panels used in the working and comparative examples are as follows:

SPC: cold-rolled steel panel: Japanese Industrial Standard ("JIS") G-3141

EG: steel panel electrogalvanized on both sides, plating weight=20 grams of plating per square meter of panel surface, a concentration unit that may be used hereinafter for any coating over a surface and is usually abbreviated as "$g/m^2$".

GA: steel panel hot-dip galvanized and galvannealed on both sides, zinc coating weight=45 $g/m^2$.

Zn—Ni: steel panel electroplated with zinc-nickel on both sides, plating weight=20 $g/m^2$ Al aluminum panel: JIS-5052

Treatment process steps, when there is no specific indication to the contrary:

(1) Alkaline degreasing: spray. 42° C. 120 seconds
(2) Water rinse: spray, room temperature, 30 seconds
(3) Surface conditioning: dipping, room temperature, 20 seconds
(4) Zinc phosphate treatment: dipping, 42° C., 120 seconds
(5) Water rinse: spray, room temperature, 30 seconds
(6) Deionized water rinse: spray, room temperature, 30 seconds Alkaline degreasing solution FINECLEANER® L4460 concentrate (commercially available from Nihon Parkerizing Company, Limited), diluted to 2% with tapwater to provide a concentration of 2% of the concentrate in the diluted working degreasing solution, was used in the working and comparative examples.

Surface conditioner

The compositions of the surface conditioning pretreatment baths used in the working examples are reported in Table 1. The compositions of the surface conditioning pretreatment baths used in the comparative examples are reported in Table 2. The time-elapsed testing was run after holding the surface conditioning pretreatment bath at room temperature for one week after preparation.

TABLE 1

| Identification | Alkali Metal Salt Type and Concentration | Metal Oxide Type and Concentration | Divalent or Trivalent Metal Phosphate: Type and Concentration | Divalent or Trivalent Metal Phosphate: Particle Size (μm) | pH |
|---|---|---|---|---|---|
| Example 1 | $Na_3PO_4.12H_2O$, 5 g/L | none | $Zn_3(PO_4)_2.4H_2O$, 2 g/L | 0.31 | 10.0 |
| Example 2 | $Na_3PO_4.12H_2O$, 5 g/L | $SiO_2$, 10 ppm | $Zn_3(PO_4)_2.4H_2O$, 2 g/L | 0.31 | 10.0 |
| Example 3 | $Na_3PO_4.12H_2O$, 5 g/L | $SiO_2$, 10 ppm | $Zn_3(PO_4)_2.4H_2O$, 2 g/L | 4.2 | 10.0 |
| Example 4 | $Na_3PO_4.12H_2O$, 5 g/L | $SiO_2$, 10 ppm | $Zn_3(PO_4)_2.4H_2O$, 2 g/L | 0.09 | 10.0 |
| Example 5 | $Na_3PO_4.12H_2O$, 5 g/L | $SiO_2$, 10 ppm | $Zn_2Fe(PO_4)_2.4H_2O$, 2 g/L | 0.29 | 10.0 |
| Example 6 | $Na_3PO_4.12H_2O$, 5 g/L | $SiO_2$, 10 ppm | $Zn_xMn_y(PO_4)_2$, 2 g/L | 0.32 | 10.0 |
| Example 7 | $Na_3PO_4.12H_2O$, 5 g/L | $SiO_2$, 10 ppm | $Zn_2Ca(PO_4)_2.4H_2O$, 2 g/L | 0.3 | 10.0 |
| Example 8 | $Na_3PO_4.12H_2O$, 5 g/L | $ZrO_2$, 10 ppm | $Zn_3(PO_4)_2.4H_2O$, 0.02 g/L | 0.31 | 8.0 |
| Example 9 | $Na_3PO_4.12H_2O$, 5 g/L | $Sb_2O_5$, 10 ppm | $Zn_3(PO_4)_2.4H_2O$, 30 g/L | 0.31 | 10.0 |
| Example 10 | $Na_2OSiO_2.5H_2O$, 5 g/L | $SiO_2$, 10 ppm | $Zn_3(PO_4)_2.4H_2O$, 2 g/L | 0.31 | 10.0 |
| Example 11 | $Na_2CO_3.NaHCO_3.2H_2O$, 5 g/L | $SiO_2$, 10 ppm | $Zn_3(PO_4)_2.4H_2O$, 2 g/L | 0.31 | 8.0 |
| Example 12 | $Na_3PO_4.12H_2O$, 1 g/L | $SiO_2$, 10 ppm | $Zn_3(PO_4)_2.4H_2O$, 2 g/L | 0.31 | 6.0 |
| Example 13 | $Na_3PO_4.12H_2O$, 20 g/L | $SiO_2$, 10 ppm | $Zn_3(PO_4)_2.4H_2O$, 2 g/L | 0.31 | 13.0 |
| Example 14* | $Na_3PO_4.12H_2O$, 5 g/L | $SiO_2$, 10 ppm | $Zn_3(PO_4)_2.4H_2O$, 2 g/L | 0.31 | 10.0 |
| Example 15** | $Na_3PO_4.12H_2O$, 5 g/L | $SiO_2$, 10 ppm | $Zn_3(PO_4)_2.4H_2O$, 2 g/L | 0.31 | 10.0 |
| Example 16 | $Na_3PO_4.12H_2O$, 5 g/L | $SiO_2$, 10 ppm | $Zn_3(PO_4)_2.4H_2O$, 2 g/L | *** | 10.0 |

Footnotes for Table 1

*In Example 14, the bath composition of the surface conditioning pretreatment bath was the same as in Example 2, but the treatment temperature was 40° C.

**In Example 15, the already specified active ingredients of the surface conditioning pretreatment bath and the treatment temperature were the same as in Example 14, but 2 g/L of a surfactant (ethoxylated nonylphenol with an average of 11 molecules of ethylene oxide per nonyl phenol molecule was also added.

*** This material had a bimodal particle size distribution; see main text for details.

TABLE 2

| Identification | Type and Concentration of Alkali Metal Salt | Metal Oxide Type and Concentration | Divalent or Trivalent Metal Phosphate or Other Surface Conditioner: Type and Concentration | Divalent or Trivalent Metal Phosphate or Other Surface Conditioner: Particle Size (μm) | pH |
|---|---|---|---|---|---|
| Comparative Example 1 | none | none | PREPALENE ® ZN 1 g/L | — | 9.5 |
| Comparative Example 2 | none | $SiO_2$, 10 ppm | PREPALENE ® ZN 1 g/L | — | 9.5 |
| Comparative Example 3 | none | none | PREPALENE ® ZN 1 g/L | — | 7.0 |
| Comparative Example 4 | none | none | PREPALENE ® ZN 1 g/L | — | 12.0 |
| Comparative Example 5* | none | none | PREPALENE ® ZN 1 g/L | — | 9.5 |

TABLE 2-continued

| Identification | Type and Concentration of Alkali Metal Salt | Metal Oxide Type and Concentration | Divalent or Trivalent Metal Phosphate or Other Surface Conditioner: Type and Concentration | Particle Size ($\mu$m) | pH |
|---|---|---|---|---|---|
| Comparative Example 6 | none | $SiO_2$, 10 ppm | $Zn_3(PO_4)_2.4H_2O$ 2 g/L | 0.31 | 10.0 |
| Comparative Example 7 | $Na_3PO_4.12H_2O$ 5 g/L | $SiO_2$, 10 ppm | $Zn_3(PO_4)_2.4H_2O$ 2 g/L | 6.5 | 10.0 |
| Comparative Example 8 | $Na_3PO_4.12H_2O$ 5 g/L | $SiO_2$, 10 ppm | $Zn_3(PO_4)_2.4H_2O$ 2 g/L | 0.31 | 3.0 |

Footnote for Table 2

*In Comparative Example 5, the bath composition of the surface conditioning pretreatment bath was the same as in Comparative Example 1, but the treatment temperature was 40° C.

EXAMPLE 1

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 0.31 $\mu$m. The concentration of the divalent metal phosphate in the filtrate was also adjusted to 2 g/L. The surface conditioning pretreatment bath reported in Table 1 was prepared by addition of the trisodium phosphate reagent (an alkali metal salt) to the concentration adjusted suspension and subsequent adjustment of the pH to the specified value.

EXAMPLE 2

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 0.31 $\mu$m. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 3

$Zn_3(PO_4)_2.4H_2O$ reagent was ground for 1 minute in a mortar and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 4.2 $\mu$m. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 4

$Zn_3(PO_4)_2.4H_2O$ reagent was ground for 1 hour in a ball mill using zirconia beads and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 0.09 $\mu$m. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 5

A precipitate was produced by alternately adding 100 milliliters (hereinafter usually abbreviated as "mL") of a 1 mole per liter (hereinafter usually abbreviated as "mol/L") zinc sulfate solution and 100 mL of a 1 mol/L sodium monohydrogen phosphate solution to 1 liter (hereinafter usually abbreviated as "L") of a 0.5 mol/L iron(II) sulfate solution heated to 50° C. The aqueous solution containing the precipitate was then heated at 90° C. for 1 hour in order to ripen the precipitate particles. This was followed by washing 10 times by decantation. The precipitate was recovered by filtration and dried and then analyzed by x-ray diffraction. The results indicated that the precipitate was primarily phosphophyllite (i.e., $Zn_2Fe(PO_4)_2.4H_2O$) containing some trivalent iron phosphate. This phosphophyllite was ground for 10 minutes in a ball mill using zirconia beads and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 0.29 $\mu$m. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 6

A precipitate was produced by the addition of 200 mL of a 1 mol/L zinc nitrate solution and then 200 mL of a 1 mol/L sodium monohydrogen phosphate solution to 1 L of a 0.1 mol/L manganese nitrate solution heated to 50° C. The aqueous solution containing the precipitate was then heated at 90° C. for 1 hour in order to ripen the precipitate particles. This was followed by washing 10 times by decantation. A portion of the precipitate recovered by filtration was dissolved in hydrochloric acid and analyzed using an atomic absorption spectrometer. The results indicated that the precipitate was $Zn_xMn_Y(PO_4)_2$, where x+Y=3. This $Zn_xMn_Y(PO_4)_2$ was ground for 10 minutes in a ball mill using zirconia beads and was then used as the divalent metal phosphate. This divalent metal phosphate was converted into a suspension and then filtered through 5-μm filter paper. Measurement of the average particle size in the filtrate using a submicron particle analyzer (Coulter Model N4 from the Coulter Company) gave a value of 0.32 μm. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 7

A precipitate was produced by the addition of 200 mL of a 1 mol/L zinc nitrate solution and then 200 mL of a 1 mol/L sodium monohydrogen phosphate solution to 1 L of a 0.1 mol/L calcium nitrate solution heated to 50° C. The aqueous solution containing the precipitate was then heated at 90° C. for 1 hour in order to ripen the precipitate particles. This was followed by washing 10 times by decantation. The precipitate was recovered by filtration and dried and was analyzed by x-ray diffraction. The results indicated that the precipitate was scholzite ($Zn_2Ca(PO_4)_2.4H_2O$). This scholzite was ground for 10 minutes in a ball mill using zirconia beads and was then used as the divalent metal phosphate. This divalent metal phosphate was converted into a suspension and then filtered through 5-μm filter paper. Measurement of the average particle size in the filtrate using a submicron particle analyzer (Coulter Model N4 from the Coulter Company) gave a value of 0.30 μm. The concentration of the divalent metal phosphate in the filtrate was also adjusted to 2 g/L. The surface conditioning pretreatment bath reported in Table 1 was prepared by-addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 8

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-μm filter paper. Measurement of the average particle size in the filtrate using a submicron particle analyzer (Coulter Model N4 from the Coulter Company) gave a value of 0.31 μm. The concentration of the divalent metal phosphate in the filtrate was also adjusted to 0.02 g/L. The surface conditioning pretreatment bath reported in Table 1 was prepared by addition of the $ZrO_2$ sol (microparticulate oxide, NZS-30B from Nissan Kagaku Kogyo Kabushiki Kaisha) and then the trisodium phosphate reagent (an alkali metal salt) to the concentration-adjusted suspension and subsequent adjustment of the pH to the specified value.

EXAMPLE 9

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-μm filter paper. Measurement of the average particle size in the filtrate using a submicron particle analyzer (Coulter Model N4 from the Coulter Company) gave a value of 0.31 μm. The concentration of the divalent metal phosphate in the filtrate was also adjusted to 30 g/L. The surface conditioning pretreatment bath reported in Table 1 was prepared by addition of the $Sb_2O_5$ sol (microparticulate oxide, A-1530 from Nissan Kagaku Kogyo Kabushiki Kaisha) and then the trisodium phosphate reagent (an alkali metal salt) to the concentration-adjusted suspension and subsequent adjustment of the pH to the specified value.

EXAMPLE 10

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-μm filter paper. Measurement of the average particle size in the filtrate using a submicron particle analyzer (Coulter Model N4 from the Coulter Company) gave a value of 0.31 μm. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the sodium metasilicate reagent (an alkali metal salt) to the concentration-adjusted suspension and subsequent adjustment of the pH to the specified value.

EXAMPLE 11

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-μm filter paper. Measurement of the average particle size in the filtrate using a submicron particle analyzer (Coulter Model N4 from the Coulter Company) gave a value of 0.31 μm. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the sodium sesquicarbonate reagent (an alkali metal salt) to the concentration-adjusted suspension and subsequent adjustment of the pH to the specified value.

EXAMPLE 12

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-μm filter paper. Measurement of the average particle size in the filtrate using a submicron particle analyzer (Coulter Model N4 from the Coulter Company) gave a value of 0.31 μm. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 13

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 0.31 $\mu$m. The concentration of the divalent metal phosphate in the filtrate was also adjusted to 2 g/L. The surface conditioning pretreatment bath reported in Table 1 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

EXAMPLE 14

The surface conditioning pretreatment was run using the treatment bath described in Example 2 at a treatment temperature of 40° C.

EXAMPLE 15

In this example, 2 g/L of surfactant, specifically ethoxylated nonylphenol with an average of 11 molecules of ethylene oxide per molecule of nonyl phenol, was added to the treatment bath described in Example 14. The nondegreased test specimen still coated with oil was subjected to a simultaneous degreasing and surface conditioning treatment at a treatment temperature of 40° C.

EXAMPLE 16

$Zn_3(PO_4)_2.4H_2O$ reagent was ground for 10 minutes in a ball mill using zirconia beads and was then used as the divalent metal phosphate. The concentration of this divalent metal phosphate was brought to 2 g/L. Measurement of the average particle size in the suspension using a submicron particle analyzer (Coulter Model N4 from the Coulter Company) and a Coulter Counter (Coulter Co.) indicated the presence of peaks at 0.31 $\mu$m and 6.5 $\mu$m in the particle size distribution. The content of the particles at 6.5 $\mu$m was 20%. The surface conditioning pretreatment bath reported in Table 1 was prepared by addition of the $SiO_2$ (a microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

Comparative Example 1

Surface conditioning pretreatment was run under standard conditions using an aqueous solution of PREPALENE® ZN (commercially available from Nihon Parkerizing Co., Ltd.) prior art surface conditioning pretreatment solution.

Comparative Example 2

Surface conditioning pretreatment was run with the addition of $SiO_2$ microparticulate oxide (Aerosil #300 from Nippon Aerosil Kabushiki Kaisha) as reported in Table 2 to an aqueous solution of PREPALENE® ZN prior art surface conditioning pretreatment.

Comparative Example 3

Surface conditioning pretreatment was run by adjusting the pH of the aqueous solution of PREPALENE® ZN prior art surface conditioning pretreatment solution to the value reported in Table 2.

Comparative Example 4

Surface conditioning pretreatment was run by adjusting the pH of the aqueous solution of PREPALENE® ZN prior art surface conditioning pretreatment solution to the value reported in Table 2.

Comparative Example 5

Surface conditioning pretreatment was run using 40° C. for the treatment temperature of the aqueous solution of PREPALENE® ZN prior art surface conditioning pretreatment solution.

Comparative Example 6

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 0.31 $\mu$m. The concentration of the divalent metal phosphate in the filtrate was also adjusted to 2 g/L. The surface conditioning pretreatment bath reported in Table 2 was prepared by addition of the $SiO_2$ (microparticulate oxide, Aerosil #300 from Nippon Aerosil Kabushiki Kaisha) to the concentration-adjusted suspension and subsequent adjustment of the pH to the specified value.

Comparative Example 7

$Zn_3(PO_4)_2.4H_2O$ reagent was used as the divalent metal phosphate. This divalent metal phosphate was made into a suspension and the suspension was filtered through 5-$\mu$m filter paper. The particles remaining on the filter paper were redispersed in water to prepare a suspension. Measurement of the average particle size in the suspension using a Coulter Counter (Coulter Company) gave a value of 6.5 $\mu$m. The concentration of the divalent metal phosphate in the suspension was also adjusted to 2 g/L. The surface conditioning pretreatment bath reported in Table 2 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

Comparative Example 8

$Zn_3(PO_4)_2.4H_2O$ reagent was ground for 10 minutes in a ball mill using zirconia beads and was then used as the divalent metal phosphate. This divalent metal phosphate was converted into a suspension and then filtered through 5-$\mu$m filter paper. Measurement of the average particle size in the filtrate using a submicron particle analyzer (Coulter Model N4 from the Coulter Company) gave a value of 0.31 $\mu$m. The concentration of the divalent metal phosphate in the filtrate was also adjusted to 2 g/L. The surface conditioning pretreatment bath reported in Table 2 was prepared by addition of the $SiO_2$ (microparticulate oxide, Aerosil #300 from Nippon Aerosil Kabushiki Kaisha) and then the trisodium phosphate reagent (an alkali metal salt) to the concentration-adjusted suspension and subsequent adjustment of the pH to the specified value.

The Zinc Phosphate Treatment Bath

In both the working and comparative examples, PALBOND® L3020 concentrate, (commercially available from Nihon Parkerizing Company, Limited), diluted with tapwater to give 4.8% of the concentrate in the diluted solution and to adjust total acidity, free acidity, and accelerator concentration to the concentrations in general use for automotive zinc phosphate treatment was used as the zinc phosphate treatment bath.

Methods for Evaluating the Unpainted Zinc Phosphate Coatings (1) Appearance

Void areas and nonuniformity in the zinc phosphate coating were visually determined and were evaluated on the following scale.

++: excellent and uniform appearance

+: some nonuniformity observed

Δ: nonuniformity and void areas occurred x: substantial void areas observed xx: no conversion coating (2) Coating weight (CW)

The weight of the conversion-treated panel was measured to give W1 (g). The coating on the conversion-treated panel was then stripped (stripping bath and conditions given below) and the weight was again measured to give W2 (g). The coating weight was calculated from the following equation: coating weight ($g/m^2$)=(W1−W2)/0.021.

For the cold-rolled steel panels:

stripping bath: 5% aqueous chromic acid solution stripping conditions: 75° C., 15 minutes, dipping For the galvanized panels:

stripping bath: 2 weight % ammonium dichromate+49 weight % of 28 weight % aqueous ammonia+49 weight % pure water stripping conditions: room temperature, 15 minutes, dipping.

(3) Coating crystal size (CS)

The deposited coating crystals were inspected using a scanning electron microscope (SEM) at 1,500 × in order to determine crystal size.

(4) P ratio

In both the working and comparative examples, this value was determined only on the SPC steel panels by measuring the x-ray intensity of the phosphophyllite crystals (P) and x-ray intensity of the hopeite crystals (H) in the zinc phosphate conversion coating using an x-ray diffraction instrument. The P ratio was calculated, using the obtained x-ray intensity values, from the following equation: P ratio= P/(P+H).

Painting and Post-painting Evaluation Methods

In both the working and comparative examples, after completion of the phosphate treatment and rinsing thereafter, some of the test panels were first painted with a cationic electrodeposition paint (ELECRON™ 2000 from Kansai Paint Kabushiki Kaisha) so as to provide a coating thickness of 20 μm and were baked at 180° C. for 25 minutes. Some of the panels were then submitted in this condition to salt spray testing and testing of resistance to hot salt water. The remaining electrocoated panels were painted with a middle coat paint (Automotive Middle Coat Paint from Kansai Paint) so as to provide a middle coat thickness of 40 μm and were baked at 140° C. for 30 minutes. The middle-coated test panels were then painted with a topcoat (Automotive Topcoat Paint from Kansai Paint) so as to provide a topcoat thickness of 40 μm and were baked at 140° C. for 30 minutes. The resulting tricoated panels (total coating thickness=100 μm) were submitted to the following tests:

(1) Salt spray test (JIS Z-2371)

The cross-enscribed electrodeposition-painted panel was sprayed with 5% salt water for 960 hours. After termination of the spray, evaluation was carried out by measuring the maximum one-side width of the rust around the enscribed cross.

(2) Testing of resistance to hot salt water.

The cross-enscribed electrodeposition-painted panel was dipped in 5% salt water for 240 hours. After termination of dipping, evaluation was carried out by measuring the maximum one-side width of the rust around the enscribed cross.

(3) Evaluation of the primary adhesiveness

A 100-square checkerboard pattern with 2-mm sided squares was scribed in the tricoated panel using a sharp cutter. Pressure-sensitive adhesive tape was then applied to the checkerboard and peeled off, after which the number of peeled off paint squares was counted.

(4) Evaluation of the secondary adhesiveness

The tricoated panel was dipped in deionized water at 40° C. for 240 hours. After the end of dipping, a checkerboard peel test was carried out as described above for the primary adhesiveness evaluation and the number of peeled off paint squares was counted.

Table 3 reports the properties of the conversion coatings obtained by zinc phosphate treatment using the surface conditioning pretreatment baths of the working examples, and Table 4 reports the properties of the conversion coatings obtained by zinc phosphate treatment using the surface conditioning pretreatment baths of the comparative examples. Table 5 reports the results for evaluation of the post-paint performance of the conversion coatings obtained by zinc phosphate treatment using the surface conditioning pretreatment baths of the working examples, and Table 6 reports the results for evaluation of the post-paint performance of the conversion coatings obtained by zinc phosphate treatment using the surface conditioning pretreatment baths of the comparative examples.

Tables 3 and 4 confirm a major improvement in the storage time stability of the surface conditioning pretreatment baths according to the present invention. The storage time stability has been a problem with prior art products. Examples 1 and 2 confirm the effect of the microparticulate oxide on the timewise stability. Furthermore, the effects did not vary even in the face of changes in the type of microparticulate oxide and alkali metal salt and in the treatment temperature, and in each case fine-sized, dense crystals were obtained that were equal or superior to those afforded by the prior art products.

TABLE 3

| Test Identification | Substrate Identification | Test Result for Treatment with Conditioning Pretreatment of: Ex. 1 | Ex. 2 | Ex. 3 | Ex. 4 | Ex. 5 | Ex. 6 | Ex. 7 | Ex. 8 |
|---|---|---|---|---|---|---|---|---|---|
| | Immediately after making up the surface conditioning pretreatment bath | | | | | | | | |
| Appearance | SPC | ++ | ++ | ++ | ++ | ++ | ++ | ++ | ++ |
| | EG | ++ | ++ | ++ | ++ | ++ | ++ | ++ | ++ |
| | GA | ++ | ++ | ++ | ++ | ++ | ++ | ++ | ++ |
| | Al | ++ | ++ | ++ | ++ | ++ | ++ | ++ | ++ |

TABLE 3-continued

| | | | | | | | | | |
|---|---|---|---|---|---|---|---|---|---|
| | Zn—Ni | ++ | ++ | ++ | ++ | ++ | ++ | ++ | ++ |
| CW ($g/m^2$) | SPC | 2.0 | 2.0 | 2.3 | 1.6 | 2.0 | 2.2 | 2.1 | 2.0 |
| | EG | 2.3 | 2.2 | 2.5 | 2.0 | 2.2 | 2.2 | 2.2 | 2.3 |
| | GA | 2.5 | 2.5 | 2.7 | 2.2 | 2.4 | 2.6 | 2.5 | 2.6 |
| | Al | 1.6 | 1.5 | 1.6. | 1.4 | 1.5 | 1.5 | 1.7 | 1.5 |
| | Zn—Ni | 2.2 | 2.2 | 2.4 | 1.9 | 2.1 | 2.1 | 2.2 | 2.2 |
| CS ($\mu$m) | SPC | 1–2 | 1–2 | 2–3 | ≦1 | 1–2 | 1–2 | 1–2 | 1–2 |
| | EG | 1–2 | 1–2 | 2–3 | ≦1 | 1–2 | 1–2 | 1–2 | 1–2 |
| | GA | 2–3 | 2–3 | 3–4 | 1–2 | 2–3 | 2–3 | 2–3 | 2–3 |
| | Al | 2–3 | 2–3 | 2–3 | 1–2 | 2–3 | 2–3 | 2–3 | 2–3 |
| | Zn—Ni | 1–2 | 1–2 | 2–3 | ≦1 | 1–2 | 1–2 | 1–2 | 1–2 |
| P ratio (%) | SPC | 92 | 92 | 93 | 95 | 96 | 91 | 92 | 93 |
| | | | | After elapse of 1 week | | | | | |
| Appearance | SPC | + | ++ | ++ | ++ | ++ | ++ | ++ | ++ |
| CW ($g/m^2$) | SPC | 2.4 | 2.1 | 2.3 | 1.7 | 2.0 | 2.1 | 2.2 | 2.1 |
| CS ($\mu$m) | SPC | 2–3 | 1–2 | 2–3 | ≦1.0 | 1–2 | 1–2 | 1–2 | 1–2 |
| P ratio (%) | SPC | 93 | 93 | 94 | 93 | 95 | 92 | 92 | 93 |

| Test Identification | Substrate Identification | Test Result for Treatment with Conditioning Pretreatment of: Ex. 9 | Ex. 10 | Ex. 11 | Ex. 12 | Ex. 13 | Ex. 14 | Ex. 15 | Ex. 16 |
|---|---|---|---|---|---|---|---|---|---|
| | Immediately after making up the surface conditioning pretreatment bath | | | | | | | | |
| Appearance | SPC | ++ | ++ | ++ | ++ | ++ | ++ | ++ | ++ |
| | EG | ++ | ++ | ++ | ++ | ++ | ++ | ++ | ++ |
| | GA | ++ | ++ | ++ | ++ | ++ | ++ | ++ | ++ |
| | Al | ++ | ++ | ++ | ++ | ++ | ++ | ++ | ++ |
| | Zn—Ni | ++ | ++ | ++ | ++ | ++ | ++ | ++ | ++ |
| CW ($g/m^2$) | SPC | 2.1 | 2.1 | 2.1 | 2.0 | 2.1 | 2.2 | 2.0 | 2.0 |
| | EG | 2.2 | 2.3 | 2.4 | 2.3 | 2.4 | 2.4 | 2.2 | 2.1 |
| | GA | 2.5 | 2.6 | 2.5 | 2.5 | 2.6 | 2.6 | 2.5 | 2.5 |
| | Al | 1.6 | 1.7 | 1.5 | 1.6 | 1.7 | 1.6 | 1.5 | 1.6 |
| | Zn—Ni | 2.3 | 2.3 | 2.3 | 2.2 | 2.2 | 2.3 | 2.1 | 2.2 |
| CS ($\mu$m) | SPC | 1–2 | 1–2 | 1–2 | 1–2 | 1–2 | 1–2 | 1–2 | 1–2 |
| | EG | 1–2 | 1–2 | 1–2 | 1–2 | 1–2 | 1–2 | 1–2 | 1–2 |
| | GA | 2–3 | 2–3 | 2–3 | 2–3 | 2–3 | 2–3 | 2–3 | 2–3 |
| | Al | 2–3 | 2–3 | 2–3 | 2–3 | 2–3 | 2–3 | 2–3 | 2–3 |
| | Zn—Ni | 1–2 | 1–2 | 1–2 | 1–2 | 1–2 | 1–2 | 1–2 | 1–2 |
| P ratio (%) | SPC | 94 | 93 | 93 | 94 | 93 | 93 | 94 | 93 |
| | | | | after elapse of 1 week | | | | | |
| Appearance | SPC | ++ | ++ | ++ | ++ | ++ | ++ | ++ | ++ |
| CW ($g/m^2$) | SPC | 2.2 | 2.2 | 2.1 | 2.1 | 2.0 | 2.1 | 2.0 | 2.2 |
| CS ($\mu$m) | SPC | 1–2 | 1–2 | 1–2 | 1–2 | 1–2 | 1–2 | 1–2 | 1–2 |
| P ratio (%) | SPC | 92 | 91 | 92 | 92 | 92 | 94 | 93 | 92 |

Additional Abbreviation for Table 3 and Subsequent Tables
"Ex." means "Example".

TABLE 4

| Test Identification | Substrate Identification | Test Result for Treatment with Conditioning Pretreatment of: CE 1 | CE 2 | CE 3 | CE 4 | CE 5 | CE 6 | CE 7 | CE 8 |
|---|---|---|---|---|---|---|---|---|---|
| | Immediately after making up the surface conditioning pretreatment bath | | | | | | | | |
| Appearance | SPC | ++ | ++ | + | Δ | X | XX | XX | XX |
| | EG | ++ | ++ | + | + | + | X | X | X |
| | GA | ++ | ++ | + | + | + | X | X | X |
| | Al | ++ | ++ | Δ | Δ | X | XX | XX | X |
| | Zn—Ni | ++ | ++ | + | + | + | X | X | X |
| CW ($g/m^2$) | SPC | 2.2 | 2.3 | 2.7 | 3.0 | 3.2 | — | — | — |
| | EG | 2.6 | 2.7 | 2.8 | 2.8 | 2.9 | — | — | — |
| | GA | 2.8 | 3.0 | 3.5 | 3.7 | 3.8 | — | — | — |
| | Al | 1.8 | 1.6 | 1.8 | 1.9 | 1.8 | — | — | — |
| | Zn—Ni | 2.5 | 2.4 | 2.7 | 2.6 | 2.7 | — | — | — |
| CS ($\mu$m) | SPC | 3–4 | 3–4 | 5–6 | 6–7 | ≧7 | — | — | — |
| | EG | 3–4 | 3–4 | 5–6 | 5–6 | 6–7 | — | — | — |
| | GA | 5–6 | 5–6 | 6–7 | 6–7 | 6–7 | — | — | — |
| | Al | 4–5 | 4–5 | 5–6 | 5–6 | 6–7 | — | — | — |

TABLE 4-continued

| | | | | | | | | | |
|---|---|---|---|---|---|---|---|---|---|
| | Zn—Ni | 3–4 | 3–4 | 4–5 | 5–6 | 6–7 | — | — | — |
| P ratio (%) | SPC | 92 | 93 | 89 | 90 | 88 | — | — | — |
| | | | After elapse of 1 week | | | | | | |
| Appearance | SPC | X | Δ | XX | XX | XX | — | — | — |
| CW (g/m$^2$) | SPC | 3.2 | 2.9 | — | — | — | — | — | — |
| CS ($\mu$m) | SPC | 6–7 | 5–6 | — | — | — | — | — | — |
| P ratio (%) | SPC | — | — | — | — | — | — | — | — |

Additional Abbreviation for Table 4 and Subsequent Tables

"CE" means "Comparative Example".

TABLE 5

| Test Identification | Substrate Identification | Test Result for Treatment with Conditioning Pretreatment of: Ex. 1 | Ex. 2 | Ex. 3 | Ex. 4 | Ex. 5 | Ex. 6 | Ex. 7 | Ex. 8 |
|---|---|---|---|---|---|---|---|---|---|
| | Immediately after making up the surface conditioning pretreatment bath | | | | | | | | |
| Salt water spray, 960 hours, electro-coated panel | SPC | 1.0 | 1.0 | 1.0 | ≦0.5 | ≦0.5 | 1.0 | 1.0 | 1.0 |
| | EG | 1.5 | 1.5 | 2.0 | 1.5 | 1.0 | 1.5 | 1.5 | 2.0 |
| | GA | ≦0.5 | ≦0.5 | ≦0.5 | ≦0.5 | ≦0.5 | ≦0.5 | ≦0.5 | ≦0.5 |
| | Al | ≦0.5 | ≦0.5 | ≦0.5 | ≦0.5 | ≦0.5 | ≦0.5 | ≦0.5 | ≦0.5 |
| | Zn—Ni | 1.5 | 1.5 | 1.5 | 1.5 | 1.0 | 1.5 | 1.5 | 2.0 |
| Hot salt water resistance, 240 hours, electro-coated panel | SPC | 1.0 | 1.0 | 1.0 | ≦0.5 | ≦0.5 | 1.0 | 1.0 | 1.0 |
| | EG | 2.0 | 1.5 | 2.0 | 1.5 | 1.0 | 1.5 | 2.0 | 1.5 |
| | GA | ≦0.5 | ≦0.5 | ≦0.5 | ≦0.5 | ≦0.5 | ≦0.5 | ≦0.5 | ≦0.5 |
| | Al | ≦0.5 | ≦0.5 | ≦0.5 | ≦0.5 | ≦0.5 | ≦0.5 | ≦0.5 | ≦0.5 |
| | Zn—Ni | 1.5 | 2.0 | 1.5 | 1.5 | 1.0 | 1.5 | 1.5 | 1.5 |
| Primary adhesiveness tricoated panel, no. of peeled off paint squares | SPC | 0 | 0 | 0 | 0 | 0 | 0 | 0 | 0 |
| | EG | 0 | 0 | 0 | 0 | 0 | 0 | 0 | 0 |
| | GA | 0 | 0 | 0 | 0 | 0 | 0 | 0 | 0 |
| | Al | 0 | 0 | 0 | 0 | 0 | 0 | 0 | 0 |
| | Zn—Ni | 0 | 0 | 0 | 0 | 0 | 0 | 0 | 0 |
| Secondary adhesiveness tricoated panel, no. of peeled off paint squares | SPC | 0 | 0 | 0 | 0 | 0 | 0 | 0 | 0 |
| | EG | 0 | 0 | 0 | 0 | 0 | 0 | 0 | 0 |
| | GA | 0 | 0 | 0 | 0 | 0 | 0 | 0 | 0 |
| | Al | 0 | 0 | 0 | 0 | 0 | 0 | 0 | 0 |
| | Zn—Ni | 0 | 0 | 0 | 0 | 0 | 0 | 0 | 0 |

| Test Identification | Substrate Identification | Test Result for Treatment with Conditioning Pretreatment of: Ex. 9 | Ex. 10 | Ex. 11 | Ex. 12 | Ex. 13 | Ex. 14 | Ex. 15 | Ex. 16 |
|---|---|---|---|---|---|---|---|---|---|
| | Immediately after making up the surface conditioning pretreatment bath | | | | | | | | |
| Salt water spray, 960 hours, electro-coated panel | SPC | 1.0 | 1.0 | 1.5 | 1.0 | 1.0 | 1.0 | 1.0 | 1.0 |
| | EG | 2.0 | 1.5 | 2.0 | 1.5 | 2.0 | 2.0 | 1.5 | 1.5 |
| | GA | ≦0.5 | ≦0.5 | ≦0.5 | ≦0.5 | ≦0.5 | ≦0.5 | ≦0.5 | ≦0.5 |
| | Al | ≦0.5 | ≦0.5 | ≦0.5 | ≦0.5 | ≦0.5 | ≦0.5 | ≦0.5 | ≦0.5 |
| | Zn—Ni | 1.5 | 1.5 | 2.0 | 2.0 | 1.5 | 2.0 | 2.0 | 1.5 |
| Hot salt water resistance, 240 hours, electro-coated panel | SPC | 1.0 | 1.0 | 1.5 | 1.0 | 1.0 | 1.0 | 1.0 | 1.0 |
| | EG | 2.0 | 2.0 | 2.0 | 1.5 | 1.5 | 2.0 | 1.5 | 1.5 |
| | GA | ≦0.5 | ≦0.5 | ≦0.5 | ≦0.5 | ≦0.5 | ≦0.5 | ≦0.5 | ≦0.5 |
| | Al | ≦0.5 | ≦0.5 | ≦0.5 | ≦0.5 | ≦0.5 | ≦0.5 | ≦0.5 | ≦0.5 |
| | Zn—Ni | 1.5 | 2.0 | 1.5 | 1.5 | 2.0 | 2.0 | 1.5 | 2.0 |
| Primary adhesiveness tricoated panel, no. of peeled off paint squares | SPC | 0 | 0 | 0 | 0 | 0 | 0 | 0 | 0 |
| | EG | 0 | 0 | 0 | 0 | 0 | 0 | 0 | 0 |
| | GA | 0 | 0 | 0 | 0 | 0 | 0 | 0 | 0 |
| | Al | 0 | 0 | 0 | 0 | 0 | 0 | 0 | 0 |
| | Zn—Ni | 0 | 0 | 0 | 0 | 0 | 0 | 0 | 0 |
| Secondary adhesiveness | SPC | 0 | 0 | 0 | 0 | 0 | 0 | 0 | 0 |
| | EG | 0 | 0 | 0 | 0 | 0 | 0 | 0 | 0 |

TABLE 5-continued

| | | | | | | | | | |
|---|---|---|---|---|---|---|---|---|---|
| tricoated | GA | 0 | 0 | 0 | 0 | 0 | 0 | 0 | 0 |
| panel, no. | Al | 0 | 0 | 0 | 0 | 0 | 0 | 0 | 0 |
| of peeled off | Zn—Ni | 0 | 0 | 0 | 0 | 0 | 0 | 0 | 0 |
| paint squares | | | | | | | | | |

It was also possible to adjust the size of the ultimately obtained phosphate coating crystals by adjusting the average particle size of the divalent or trivalent metal phosphate used.

Tables 5 and 6 confirm that the surface conditioning pretreatment baths according to the present invention gave a paint performance equal or superior to that of the prior art products.

TABLE 6

| Test Identification | Substrate Identification | Test Result for Treatment with Conditioning Pretreatment of: CE 1 | CE 2 | CE 3 | CE 4 | CE 5 | CE 6 | CE 7 | CE 8 |
|---|---|---|---|---|---|---|---|---|---|
| | Immediately after making up the surface conditioning pretreatment bath | | | | | | | | |
| Salt water | SPC | 1.0 | 1.0 | 2.5 | 3.5 | ≧5.0 | — | — | — |
| spray, 960 | EG | 2.0 | 2.0 | 3.5 | 4.0 | 5.0 | — | — | — |
| hours, | GA | ≦0.5 | ≦0.5 | 2.5 | 3.0 | 3.5 | — | — | — |
| electro- | Al | ≦0.5 | ≦0.5 | 1.0 | 1.0 | 2.0 | — | — | — |
| coated panel | Zn—Ni | 2.0 | 1.5 | 3.0 | 3.5 | ≧5.0 | — | — | — |
| Hot salt | SPC | 1.0 | 1.0 | 3.0 | 4.0 | ≧5.0 | — | — | — |
| water re- | EG | 2.5 | 2.0 | 3.0 | 4.0 | ≧5.0 | — | — | — |
| sistance, | GA | ≦0.5 | ≦0.5 | 2.5 | 3.0 | 3.0 | — | — | — |
| 240 hours, | Al | ≦0.5 | ≦0.5 | 1.5 | 1.0 | 1.5 | — | — | — |
| electro- | Zn—Ni | 2.0 | 2.0 | 2.5 | 4.0 | ≧5.0 | — | — | — |
| coated panel | | | | | | | | | |
| Primary | SPC | 0 | 0 | 0 | 10 | 80 | — | — | — |
| adhesiveness | EG | 0 | 0 | 0 | 10 | 20 | — | — | — |
| tricoated | GA | 0 | 0 | 0 | 5.0 | 15 | — | — | — |
| panel, no. | Al | 0 | 0 | 0 | 10 | 25 | — | — | — |
| of peeled off | Zn—Ni | 0 | 0 | 0 | 10 | 20 | — | — | — |
| paint squares | | | | | | | | | |
| Secondary | SPC | 0 | 0 | 0 | 15 | 85 | — | — | — |
| adhesiveness | EG | 0 | 0 | 0 | 10 | 30 | — | — | — |
| tricoated | GA | 0 | 0 | 0 | 5.0 | 15 | — | — | — |
| panel, no. | Al | 0 | 0 | 0 | 15 | 30 | — | — | — |
| of peeled off | Zn—Ni | 0 | 0 | 0 | 10 | 25 | — | — | — |
| paint squares | | | | | | | | | |

What is claimed is:

1. A liquid pretreatment composition for conditioning metal surfaces by contact therewith prior to the phosphate conversion coating treatment thereof, said pretreatment composition having a pH value within a range from 4 to 13 and comprising the following components:

(A) a dissolved component selected from the group consisting of alkali metal salts, ammonium salts, and mixtures thereof; and (B) a dispersed component selected from the group consisting of phosphates of divalent and trivalent metals and mixtures of any two or more of said phosphates, said phosphates including dispersed particles with a particle size that is not more than 5 μm.

2. A pretreatment composition according to claim 1, in which the concentration of said dispersed phosphate particles with a particle size ≦5 μm is from 0.001 to 30 g/L and these particles are selected from the group consisting of the phosphates of Zn, Fe, Mn, Ni, Co, Ca, and Al.

3. A pretreatment composition according to claim 2, in which the dissolved alkali metal salt or ammonium salt is selected from the group consisting of orthophosphates, metaphosphates, orthosilicates, metasilicates, carbonates, bicarbonates, and borates and is present in a concentration from 0.5 to 20 g/L.

4. A pretreatment composition according to claim 3 that additionally contains an additional component (C) selected from the group consisting of water-soluble anionic organic polymers, water-soluble nonionic organic polymers, anionic surfactants, nonionic surfactants, and microparticulate oxides that disperse in aqueous solution in an anionically charged state.

5. A pretreatment composition according to claim 4, which contains microparticulate oxide that disperses in an anionically charged state, has an average particle size that is ≦0.5 μm, and is present in a concentration from 0.001 to 5 g/L.

6. A pretreatment composition according to claim 5, in which said microparticulate oxide that disperses in an anionically charged state is selected from the group consisting of the oxides of Si, B, Ti, Zr, Al, Sb, Mg, Se, Zn, Sn, Fe, Mo, and V.

7. A pretreatment composition according to claim 1, in which the dissolved alkali metal salt or ammonium salt is selected from the group consisting of orthophosphates, metaphosphates, orthosilicates, metasilicates, carbonates, bicarbonates, and borates and is present in a concentration from 0.5 to 20 g/L.

8. A pretreatment composition according to claim 7 that additionally contains an additional component (C) selected from the group consisting of water-soluble anionic organic polymers, water-soluble nonionic organic polymers, anionic surfactants, nonionic surfactants, and microparticulate oxides that disperse in aqueous solution in an anionically charged state.

9. A pretreatment composition according to claim 8, which contains microparticulate oxide that disperses in an anionically charged state, has an average particle size that is $\leqq 0.5$ $\mu$m, and is present in a concentration from 0.001 to 5 g/L.

10. A pretreatment composition according to claim 9, in which said microparticulate oxide that disperses in an anionically charged state is selected from the group consisting of the oxides of Si, B, Ti, Zr, Al, Sb, Mg, Se, Zn, Sn, Fe, Mo, and V.

11. A pretreatment composition according to claim 1 that additionally contains an additional component (C) selected from the group consisting of water-soluble anionic organic polymers, water-soluble nonionic organic polymers, anionic surfactants, nonionic surfactants, and microparticulate oxides that disperse in aqueous solution in an anionically charged state.

12. A pretreatment composition according to claim 11, which contains microparticulate oxide that disperses in an anionically charged state, has an average particle size that is $\leqq 0.5$ $\mu$m, and is present in a concentration from 0.001 to 5 g/L.

13. A pretreatment composition according to claim 12, in which said microparticulate oxide that disperses in an anionically charged state is selected from the group consisting of the oxides of Si, B, Ti, Zr, Al, Sb, Mg, Se, Zn, Sn, Fe, Mo, and V.

14. A pretreatment composition according to claim 1, which contains microparticulate oxide that disperses in an anionically charged state, has an average particle size that is $\leqq 0.5$ $\mu$m, and is present in a concentration from 0.001 to 5 g/L.

15. A pretreatment composition according to claim 14, in which said microparticulate oxide that disperses in an anionically charged state is selected from the group consisting of the oxides of Si, B, Ti, Zr, Al, Sb, Mg, Se, Zn, Sn, Fe, Mo, and V.

16. A process for conditioning a metal surface prior to a phosphate conversion coating treatment thereof by effecting contact between the metal surface that is to receive a phosphate conversion coating and a surface conditioning pretreatment composition according to claim 1.

17. A process according to claim 16, wherein the surface conditioning pretreatment composition additionally comprises nonionic or anionic surfactant or a mixture thereof and a builder, whereby the metal surface is simultaneously activated and cleaned.

18. A process for conditioning a metal surface prior to a phosphate conversion coating layer thereof by effecting contact between the metal surface that is to receive a phosphate conversion coating and a surface conditioning pretreatment composition according to claim 6.

19. A process for conditioning a metal surface prior to a phosphate conversion coating layer thereof by effecting contact between the metal surface that is to receive a phosphate conversion coating and a surface conditioning pretreatment composition according to claim 4.

20. A process for conditioning a metal surface prior to a phosphate conversion coating layer thereof by effecting contact between the metal surface that is to receive a phosphate conversion coating and a surface conditioning pretreatment composition according to claim 3.

* * * * *

UNITED STATES PATENT AND TRADEMARK OFFICE

CERTIFICATE OF CORRECTION

PATENT NO. : 6,214,132 B1
DATED : April 10, 2001
INVENTOR(S) : Nakayama et al.

It is certified that error appears in the above-identified patent and that said Letters Patent is hereby corrected as shown below:

Title page,
Item [22], PCT filed, delete "Mar. 9, 1999" and insert therefor -- Mar. 9, 1998 --.
Item [86], § 371 Date:, delete "Sep. 3, 1998" and insert therefor -- Sep. 3, 1999 --.

Signed and Sealed this

Twenty-fourth Day of February, 2004

JON W. DUDAS
*Acting Director of the United States Patent and Trademark Office*